US009291005B2

(12) United States Patent
Buda et al.

(10) Patent No.: US 9,291,005 B2
(45) Date of Patent: Mar. 22, 2016

(54) WIRED PIPE COUPLER CONNECTOR

(71) Applicants: Robert Buda, Lower Saxony (DE); Ingo Roders, Seelze (DE); Rene Schulz, Saxony (DE); Henning Rahn, Celle (DE)

(72) Inventors: Robert Buda, Lower Saxony (DE); Ingo Roders, Seelze (DE); Rene Schulz, Saxony (DE); Henning Rahn, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 649 days.

(21) Appl. No.: 13/687,551

(22) Filed: Nov. 28, 2012

(65) Prior Publication Data

US 2014/0144614 A1 May 29, 2014

(51) Int. Cl.
*H01R 4/60* (2006.01)
*E21B 17/02* (2006.01)

(52) U.S. Cl.
CPC ..... *E21B 17/028* (2013.01)

(58) Field of Classification Search
CPC ..... E21B 17/003
USPC ..... 439/191, 194; 166/65.1
See application file for complete search history.

(56) References Cited

U.S. PATENT DOCUMENTS

| | | | | |
|---|---|---|---|---|
| 2,178,931 | A * | 11/1939 | Crites | E21B 17/028 174/47 |
| 2,379,800 | A * | 7/1945 | Hare | E21B 47/122 324/221 |
| 6,688,396 | B2 * | 2/2004 | Floerke | E21B 17/028 166/242.6 |
| 6,811,187 | B2 | 11/2004 | Otten et al. | |
| 6,830,467 | B2 * | 12/2004 | Hall et al. | 439/194 |
| 6,836,218 | B2 | 12/2004 | Frey et al. | |
| 6,945,802 | B2 * | 9/2005 | Hall et al. | 439/194 |
| 7,535,377 | B2 * | 5/2009 | Hall | E21B 17/003 340/853.7 |
| 7,806,191 | B2 * | 10/2010 | Braden | E21B 17/028 166/242.6 |
| 8,033,329 | B2 * | 10/2011 | Montgomery | E21B 17/028 166/242.1 |
| 8,049,506 | B2 | 11/2011 | Lazarev | |
| 8,109,329 | B2 | 2/2012 | Bray et al. | |
| 8,826,972 | B2 * | 9/2014 | Flint et al. | 166/65.1 |
| 8,991,507 | B2 * | 3/2015 | Rodney et al. | 166/380 |
| 2008/0251247 | A1 | 10/2008 | Flint et al. | |
| 2009/0289808 | A1 | 11/2009 | Prammer | |
| 2011/0315399 | A1 | 12/2011 | Rodney et al. | |
| 2012/0081122 | A1 | 4/2012 | Frey | |
| 2012/0176138 | A1 | 7/2012 | Prammer | |
| 2014/0144614 | A1 * | 5/2014 | Buda | E21B 17/028 166/65.1 |
| 2014/0290930 | A1 * | 10/2014 | Peters | E21B 17/028 166/65.1 |

FOREIGN PATENT DOCUMENTS

WO 2012038468 A1 3/2012

OTHER PUBLICATIONS

Notification of Transmittal of the International Search Report and the Written Opinion of the International Searching Authority, or the Declaration; PCT/US2013/071180; Feb. 25, 2014.

Shah, et al. "Design Considerations for a New High Data Rate LWD Acoustic Telemetry System" SPE 88636. SPE Asia Pacific Oil and Gas Conference and Exhibition held in Perth, Australia, Oct. 18-20, 2004. 7 pages.

* cited by examiner

*Primary Examiner* — Neil Abrams
(74) *Attorney, Agent, or Firm* — Cantor Colburn LLP

(57) ABSTRACT

A wired pipe coupler that carries at least a data signal includes a carrier having a plurality of electrical components disposed therein and one or more antennas supported by and spaced from the carrier, the one or more antennas being electrically coupled to the carrier through respective ones of the plurality of electrical components.

26 Claims, 11 Drawing Sheets

103
116
123
115
110
152
153
151
114
124
100
113
171
119
111
122
170
161
160

WIRED PIPE COUPLER CONNECTOR

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various connecting mechanisms, such as threaded connections.

Various power and/or communication signals may be transmitted through the pipe segments via a "wired pipe" configuration. Such configurations include electrical, optical or other conductors extending along the length of selected pipe segments. The conductors are operably connected between pipe segments by a variety of connecting configurations.

One such connecting configuration includes a threaded male-female configuration often referred to as a pin-box connection. The pin-box connection includes a male member, i.e., a "pin end" that includes an exterior threaded portion, and a female member, i.e., a "box end", that includes an interior threaded portion and is configured to receive the pin in a threaded connection.

Some wired pipe configurations include a coupler mounted on the tip of the pin as well as in the box end. The coupler transmits power, data or both to an adjacent coupler. The coupler in the pin end is typically connected via a coaxial cable to a coupler in the box end.

BRIEF DESCRIPTION

Disclosed herein is a wired pipe segment that includes a body extending from a box end to a pin end and a coupler located in one of the box and pin ends. The coupler includes a carrier having at least one electrical component disposed therein and one or more antennas supported by and spaced from the carrier and being electrically coupled to the carrier through at least one of the electrical components. The wired pipe segment also includes a transmission line extending away from the coupler towards the other of the box and pin end and in electrical communication with the one or more antennas.

Also disclosed is a wired pipe coupler that carries at least a data signal an includes a carrier having a plurality of electrical components disposed therein and one or more antennas supported by and spaced from the carrier. The one or more antennas are electrically coupled to the carrier through respective ones of the plurality of electrical components.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
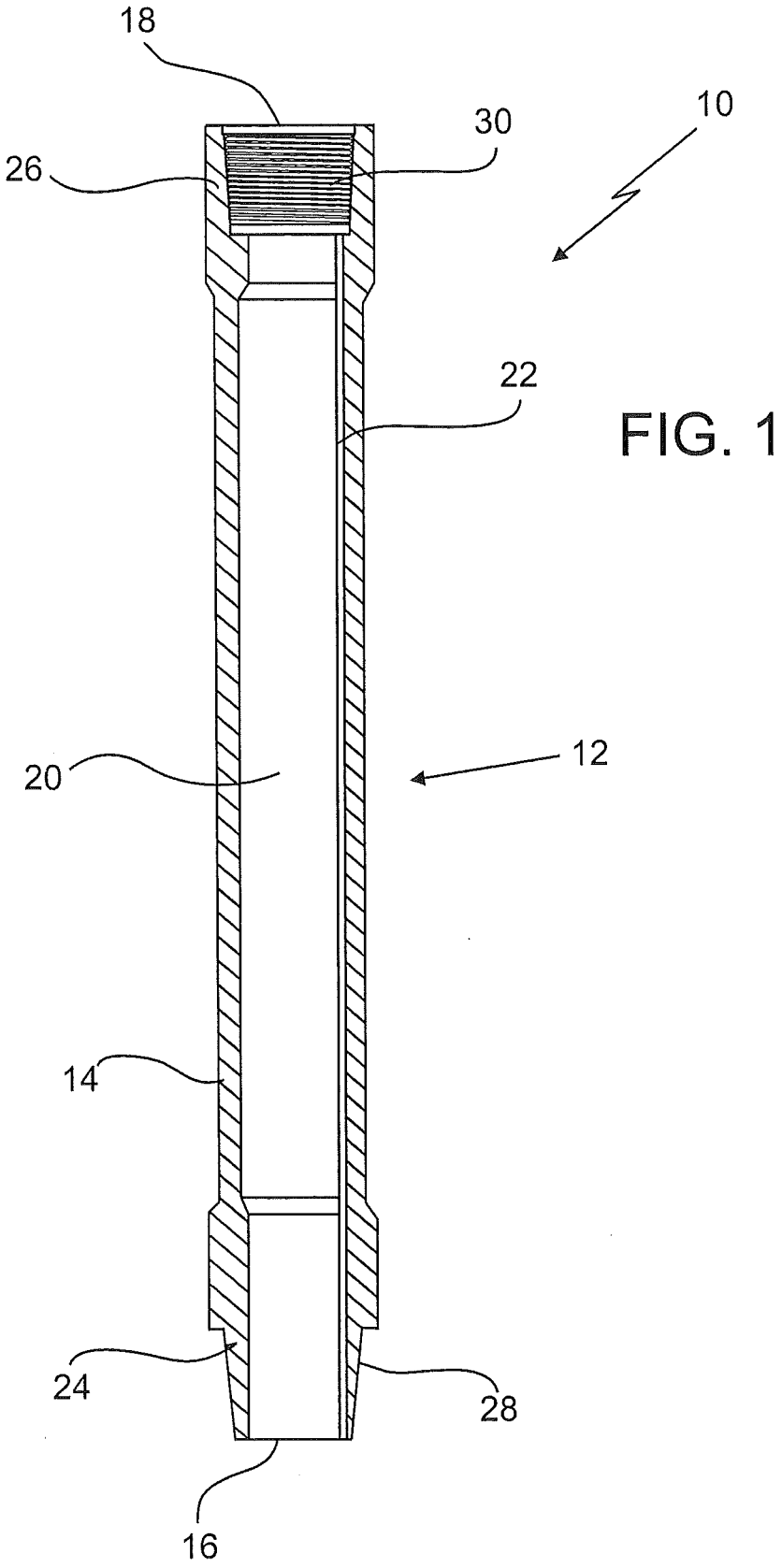
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, and facilitating hydrocarbon production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole and is discharged into the mud tank or other location.

The string 12 includes at least one string or wired pipe segment 14 having an uphole end 16 and a downhole end 18. As described herein, "uphole" refers to a location near the surface relative to a reference location when the segment 14 is disposed in a borehole, and "downhole" refers to a location away from the surface relative to the reference location.

An inner bore or other conduit 20 extends along the length of each segment 14 to allow drilling mud or other fluids to flow therethrough. A transmission line 22 is located within the segment 14 to provide protection for electrical, optical or other conductors to be disposed along the segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric. In one embodiment, the shield layer is electrically coupled to an outer conductor that may be formed, for example, by a rigid or semi-rigid tube of a conductive material.

The segment 14 includes an uphole connection 26 and a downhole connection 24. The segment 14 is configured so that the uphole connection 26 is positioned at an uphole location relative to the downhole connection 24. The downhole connection 26 includes a male connection portion 28 having an exterior threaded section, and is referred to herein as a "pin end" 26. The uphole connection 26 includes a female connection portion 30 having an interior threaded section, and is referred to herein as a "box end" 26.

The pin 24 and the box 26 are configured so that the pin 24 can be disposed within the box 26 to form a fixed connection there between to connect to an adjacent segment 12 or other downhole component. In one embodiment, the exterior of the male connecting portion 28 and the interior of the female connecting portion 30 are tapered along the length of the segment 14 to facilitate connecting. Although the pin end 24 and the box end 26 are described as having threaded portions, the pin 24 and box 26 ends may be configured to be coupled using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and couplers. The downhole or surface processing unit may also collect and process data generated by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, the string 12 is configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 2:
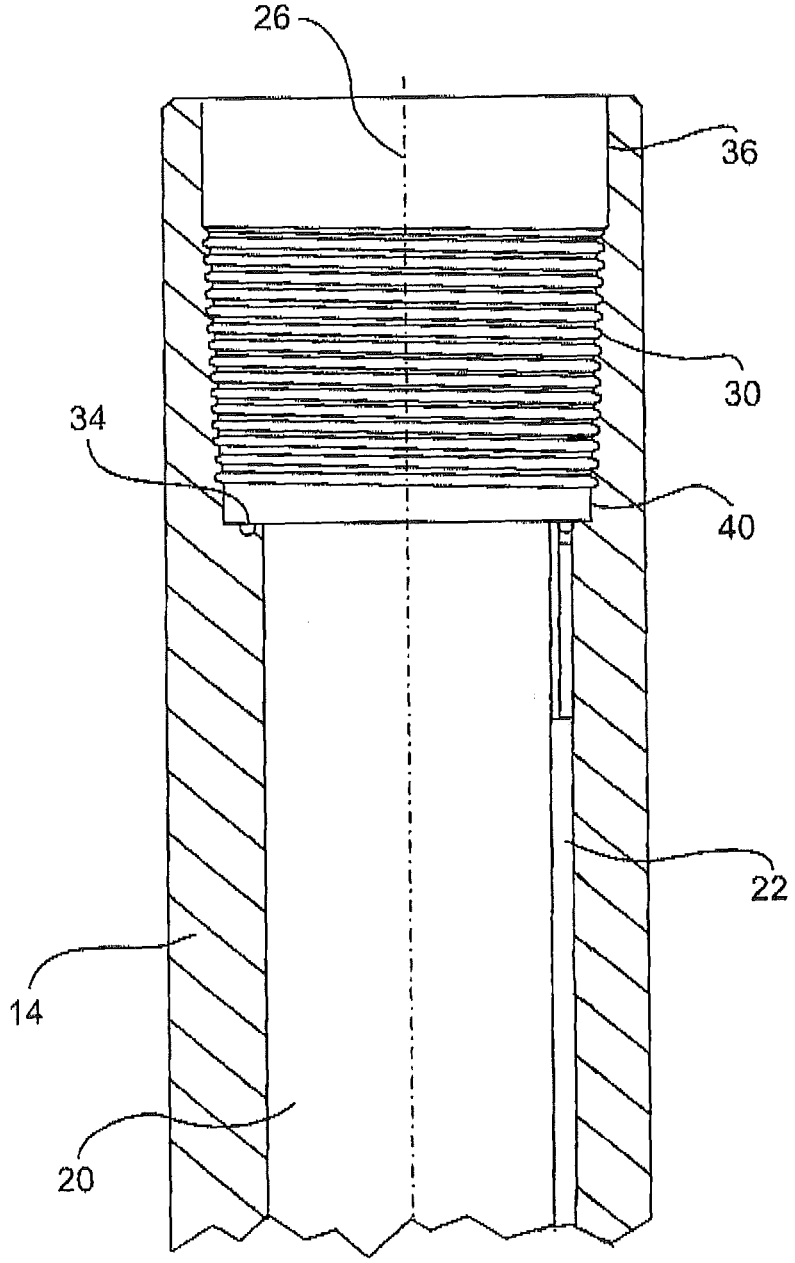
FIG. 2 depicts an exemplary embodiment of a box connector of the segment of FIG. 1.
Figure 3:
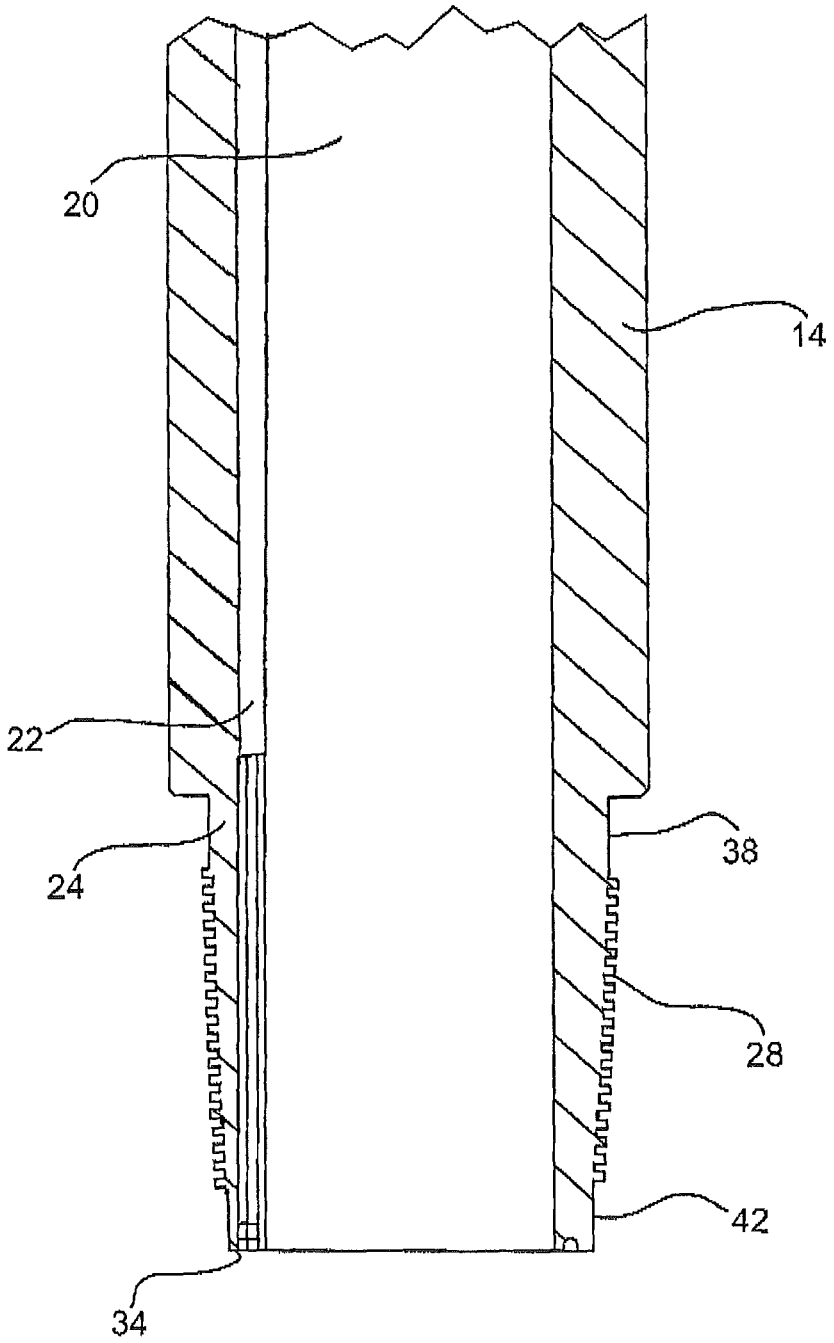
FIG. 3 depicts an exemplary embodiment of a pin connector of the segment of FIG. 1.

Referring to FIGS. 2 and 3, the segment 14 includes at least one coupler 34 disposed therein and located at the pin end 24 and/or the box end 26. The coupler 34 is configured to provide communication of at least one of data and power between adjacent segments 14 when the pin end 24 and the box end 26 are engaged. The coupler 34 may be of any suitable type, such as an inductive coil, capacitive connecting, direct electrical contacts and an optical connection ring. Further, the coupler 34 may be a resonant coupler.

It shall be understood that the coupler 34 could also be included in a repeater element disposed between adjacent segments 14 (e.g., within the box end). In such a case, the data/power is transmitted from the coupler 34 in one segment 14, into the repeater. The signal may then be passed "as is," amplified, and/or modified in the repeater and provided to the adjacent segment 14. Regardless of the configuration, it shall be understood that each coupler 34 can be connected to one or more transmission lines 22.

Figure 4:
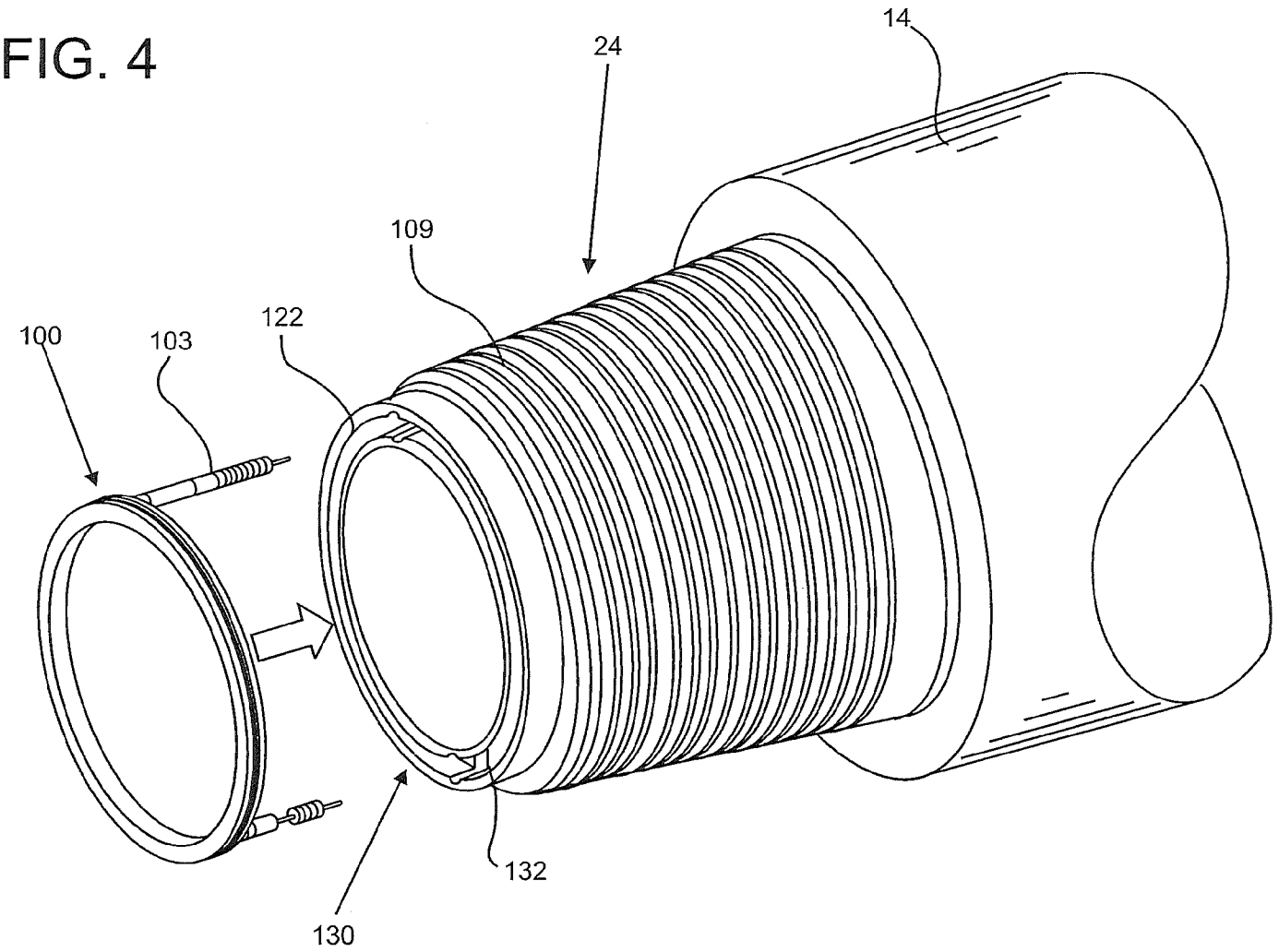
FIG. 4 illustrates a pin-end of a wired pipe segment and a coupler that is inserted into the pin-end.

FIG. 4 shows an exploded view of a pin end 24 of a segment 14 as adapted to receive an example embodiment of a coupler 100. Embodiments herein are directed to a coupler 100 that is robust enough to withstand downhole conditions (static/dynamic/shock loads, environment) and rough handling on surface when drilling components being made up, racked back or transported. To this end, and as described below, the couplers 100 disclosed herein below provide integration of several electronic components (e.g., capacitors and inductors) in very limited design space and that can be disposed in a groove formed in the pin 24 or box 26 end of pipe segment 14. The coupler 100 may provide protection and sealing of the electronic components against high drilling mud pressure.

The pin end 24 includes threads 109 that can be used, as described above, to couple the pin 24 to a box of another segment 14. A distal end 130 of the pin end 24 includes a recess 122 formed therein. As shown, the recess 122 is formed as a groove. Of course the exact configuration of the recess 122 is not limited to only such a configuration. The coupler 100 includes coupler connectors 103 configured to electrically connect to one or more transmission lines (e.g., transmission lines) disposed in the segment 14. The recess 122 is shaped such that it receives the coupler 100 and can include holes 132 to receive the coupler connectors 103 such that the coupler 100 is at least partially, or completely, disposed within the recess 122. It shall be understood that a similar recess can also be formed in the similar manner in the box end (not shown) of the segment 14.

Figure 5:
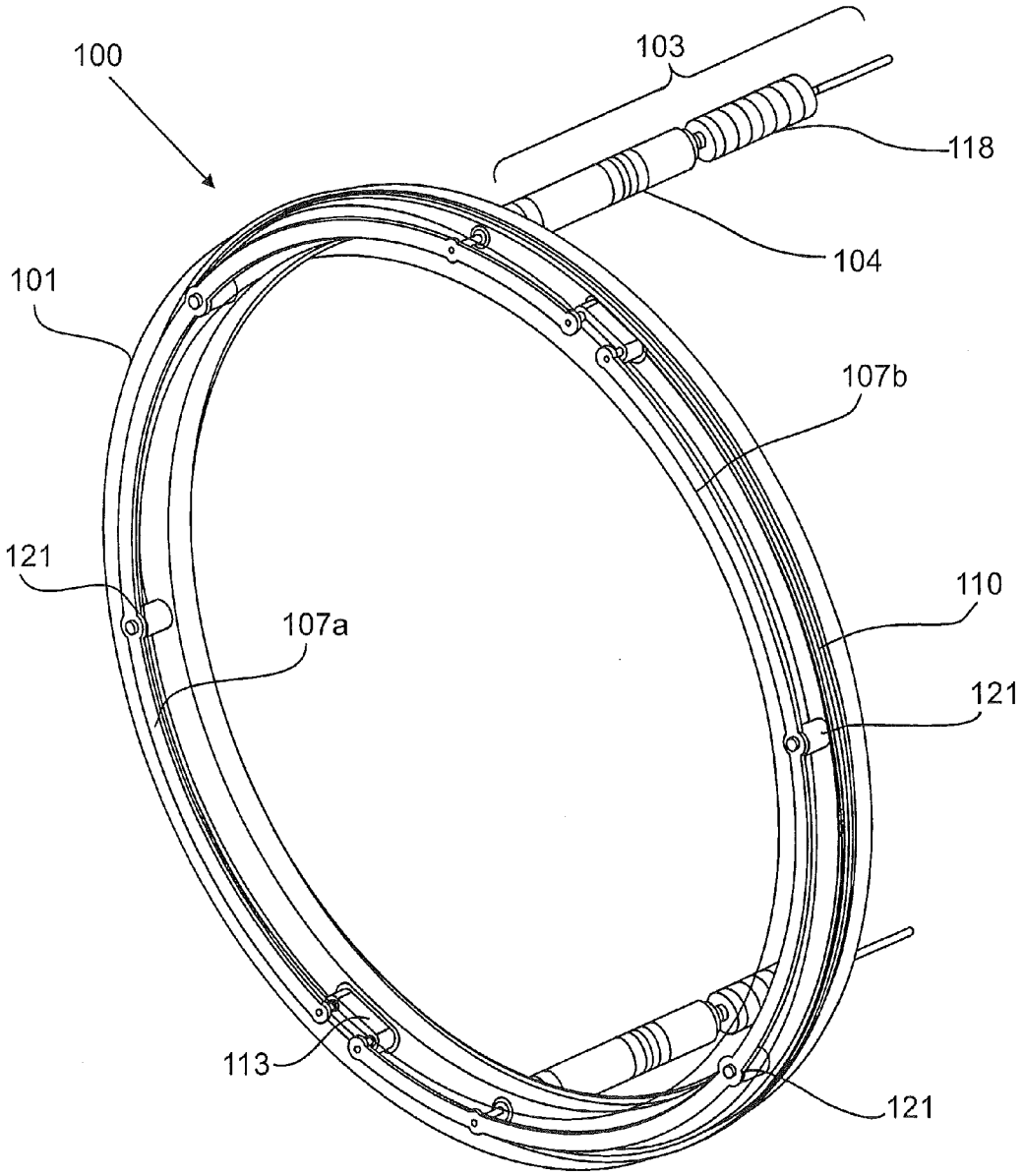
FIG. 5 is a perspective view of a coupler according to one embodiment.

FIG. 5 illustrates the coupler 100 of FIG. 5 in greater detail. The coupler 100 includes at least two separate antennas 107 (shown as 107*a* and 107*b*). Of course, the particular number of antennas 107 is not limited to only two and more could be included. In general, each antenna 107 transmits a signal that is received on a coupler connector 103 to which it is physically and electrically connected. In the illustrated embodiment, the first antenna 107*a* is physically and electrically (e.g., galvanically) connected to a first coupler connector 103*a* and a second antenna 107*b* is physically and electrically connected to a second coupler connector 103*b*. As will be described in greater detail below, the first and second antennas 107*a*, 107*b* are electrically coupled to one another by electronic components that are coupled to an electric ground formed, for example, by the segment 14. In one embodiment, the first and second antennas 107*a*, 107*b* are semi-circular in shape and extend slightly less than 180 degrees. The first and second antennas 107*a*, 107*b* are connected at both their respective ends to the other antenna through electronic components and the segment 14 in one embodiment. That is, in one embodiment, each end of each antenna 107 is coupled to separate electronics. Of course, it shall be understood that the exact location on the antenna 107 that is connected to an electronic component could be varied depending on the context.

The coupler 100 also includes a carrier 110. In one embodiment, the electronics mentioned above are disposed within the carrier 110 as is more fully described below. The carrier 110 can be formed of a metallic material such as conductive steel. The coupler 100 also includes one or more spacers 121 disposed between the antennas 107 and the carrier 110 that fix the antennas 107 in a defined position relative to the carrier 110 during operation as well as during manufacturing process. In one embodiment, the spacers 121 are made at least partially of insulating materials such as, for example, ceramic or plastics like Teflon or polyether ether ketone (PEEK). In one embodiment, the spacers 121 are optional and may be omitted.

The coupler 100 further includes two or more double connectors 113. The double connectors are carried by the carrier 110. In one embodiment the double connectors 113 are integrally formed with the carrier 110. In another embodiment the double connectors 113 are removable from the carrier 110. In such an embodiment, the double connectors 113 may be welded to the carrier 110 to ensure a pressure tight and electrically reliable connection to the carrier 110. Such a connection is important considering that the coupler 100 is to be used in a harsh downhole environment as well as during manufacturing process of the coupler 100.

While more details are given below, the coupler 100 shown in FIGS. 4 and 5 may be constructed by forming the carrier 110 and disposing the electronic components therein. The electronic components are such that they are electrically between individual pins 119 (FIG. 10*a*) of the double connector 113 and the carrier 110. One or more of the spacers 120 are also provided on the surface of the carrier 110. The coupler connectors 103 may then be attached to the carrier 110 in a manner such that pins 114 (FIGS. 6*a* and 7) pass through it and are electrically isolated from the carrier 110. The antennas 107 are then connected such that they are supported by one or more spacers 121 away from the carrier 110 and are in electrical contact with pin 114 and a pin 119 at each end. The pins 119 are both electrically coupled through electric components to the carrier 110. Of course, the exact order that the components/connections described above could be altered. For instance, the antennas 107 could be mounted on the carrier 110 by spacers 121 before the coupler connectors 103 are attached to the carrier 110.

Regardless of how formed, the assembly comprising the antennas 107, carrier 110, spacers 121 (optionally), the double connector 113 and at least a portion of the coupler connectors 103 is then encapsulated in a mold material 101. The mold material 101 could be formed of PEEK or another plastic material by injection molding or other means. The mold material 101 protects the antennas 107 in particular and the coupler 100 in general, against invasion with drilling fluid and supports the mechanical robustness of the coupler 100.

In operation, the carrier 110 may be electrically coupled to the segment 14. In this manner, the carrier 110 provides a ground to which both antennas 107*a*, 107*b* are in electrical contact with the electronic components disposed within the carrier 110. In this same manner the antennas 107*a*, 107*b* are not electrically isolated from one another.

Figures 6A, 6B:
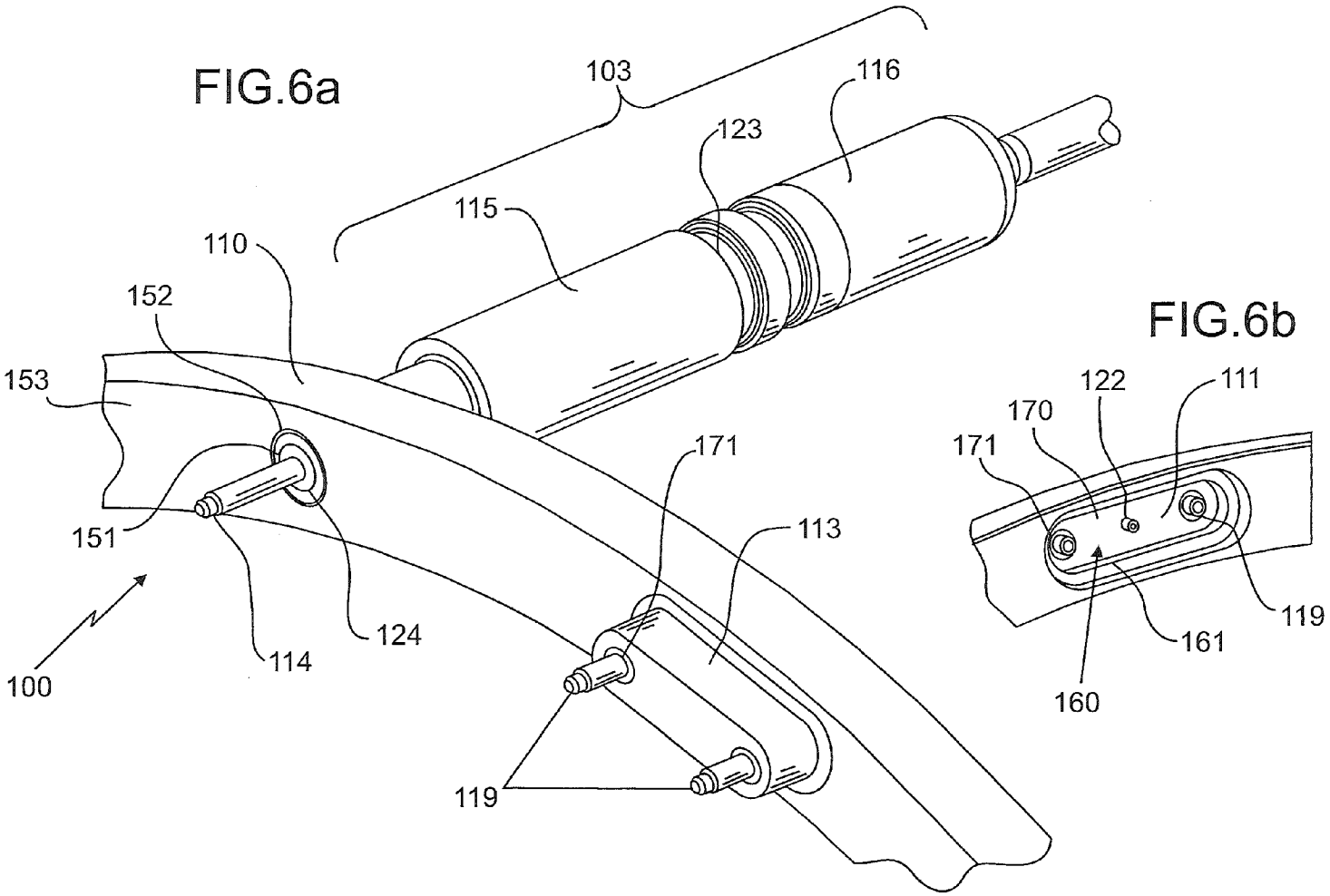
FIGS. 6*a* and 6*b* illustrate portions of a coupler according to one embodiment.

FIGS. 6*a* and 6*b* show front and back views of portions of the coupler 100 without the antennas 107. The coupler connector 103 is shown attached to the carrier 110 and includes a connector pin 114. The connector pin 114 is electrically isolated from the carrier 110. The isolation 124 of the connector pin 114 could be realized by a plastic material like PEEK or by a glass-to-metal-seal.

Figure 7:
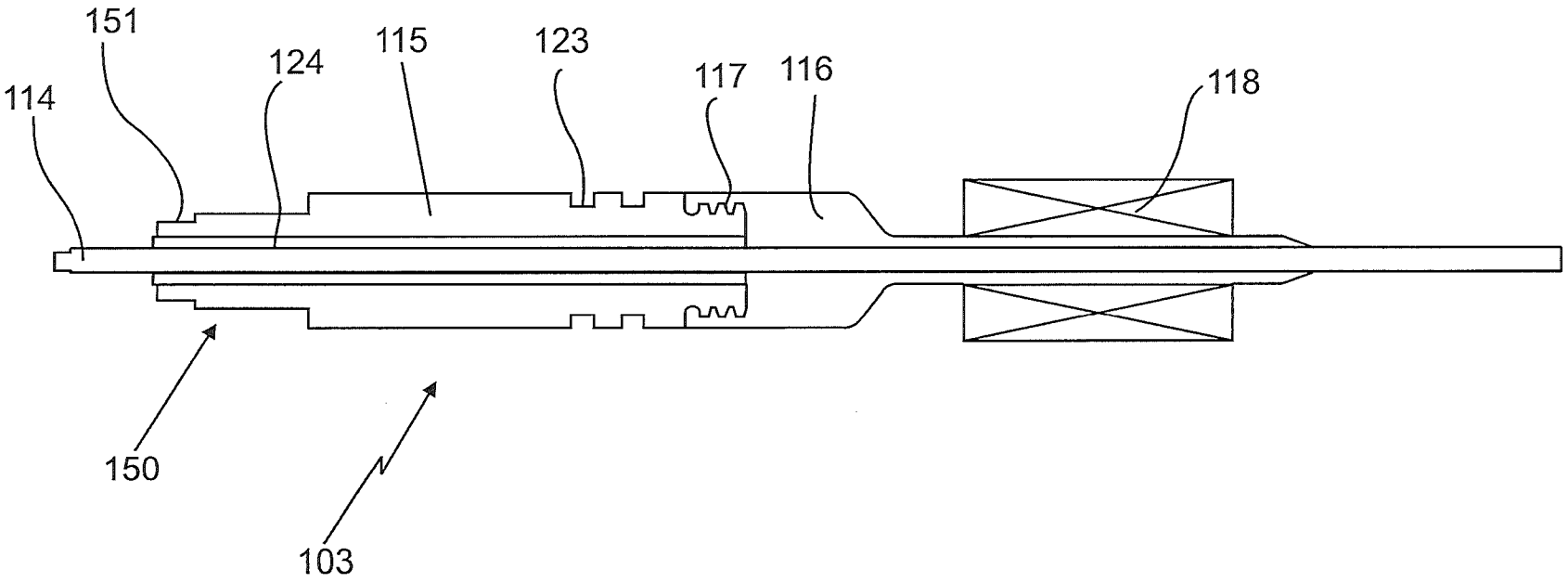
FIG. 7 shows a cut-away side view of a coupler connector according to one embodiment.

FIG. 7 shows a section view of an example of a coupler connector 103. The coupler connector 103 includes a conductive body 115. A PEEK shaft 116 covers the rear part of the connector 103. The PEEK shaft 116 shall be bonded to the conductive body 115 by injection molding or other means of manufacturing procedures for PEEK. A form fit in the area of engagement with the steel body 115 and PEEK shaft created by several engagement grooves 117 or other means could improve the bonding of both materials. The PEEK-to-metal interface should be pressure tight against 20,000 to 40,000 psi. The PEEK shaft 116 also carries a seal stack 118 that can be used to seal the coupler connector 103 with an outer conductor of a transmission medium or a channel formed in a pipe segment 14.

As illustrated in FIG. 7, the connector pin 114 is separated physically and electrically from the conductive body 115 of the coupler connector 103 by an insulating layer 124. In one embodiment, the insulating layer 124 is formed of a glass or glass-like material that may be bonded or otherwise sealed to the conductive body 115. In the event that the conductive body 115 is metal, the insulating layer 124 can be formed of a glass-to-metal seal or plastic materials such as PEEK. The illustrated connector pin 114 extends completely through the coupler connector 103 and provides an electrical path between an antenna 107 to which it is attached and a transmission line 122 traversing a pipe segment 14. In the disclosed embodiment the connector pin 114 is directly electrically connected to a particular antenna 107. Such a direct connection means that no passive or active devices are located between the connector pin 114 and the antenna 107.

During assembly, and referring to both FIGS. 6*a* and 7, the end of the contact pin 114 extending beyond the conductive body 115 is joined to an antenna segment 107 by spot-welding or other means. In one embodiment the contact pin 114 is formed of steel or copper beryllium coated with copper or gold.

Figure 8A:
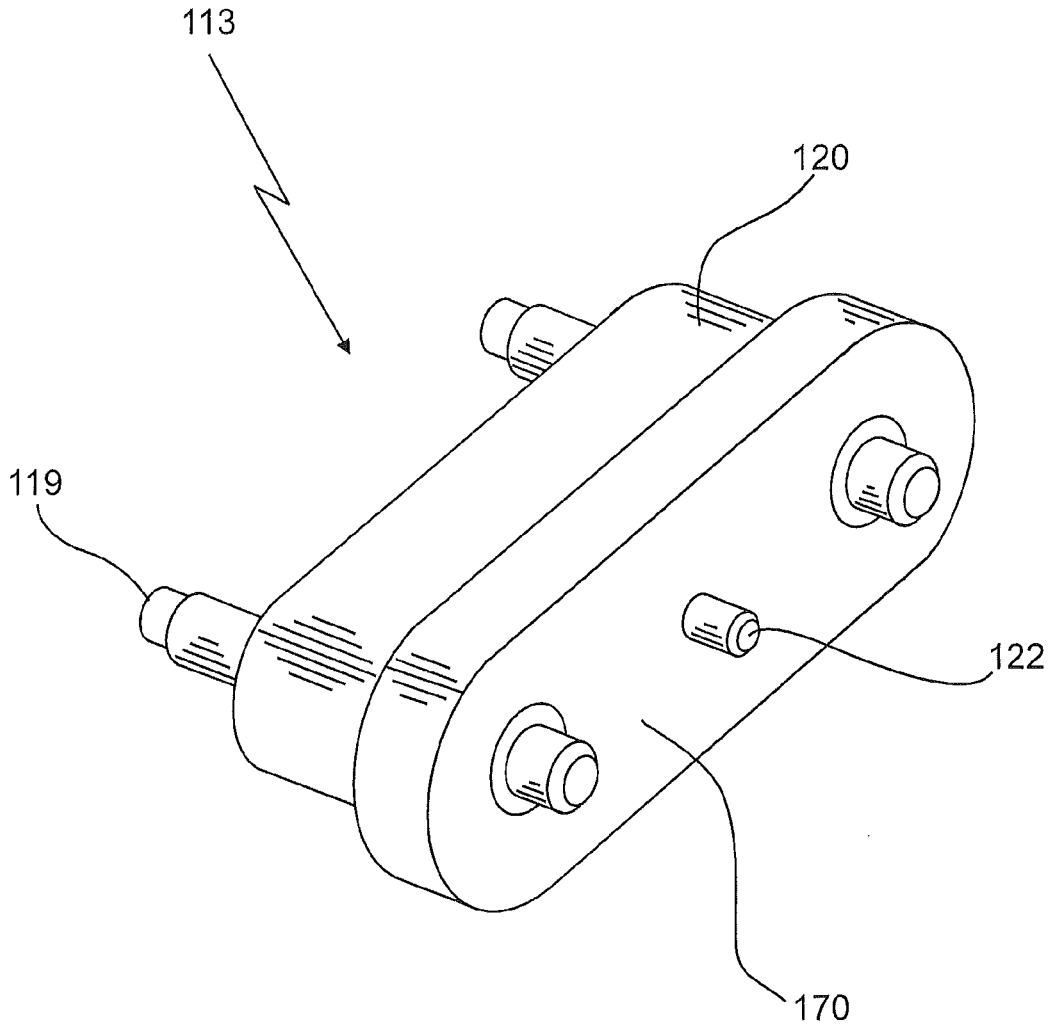
FIGS. 8*a* and 8*b*, respectively show perspective and cut-away side views of a double connector that may be used in one embodiment of a coupler.
Figure 8B:
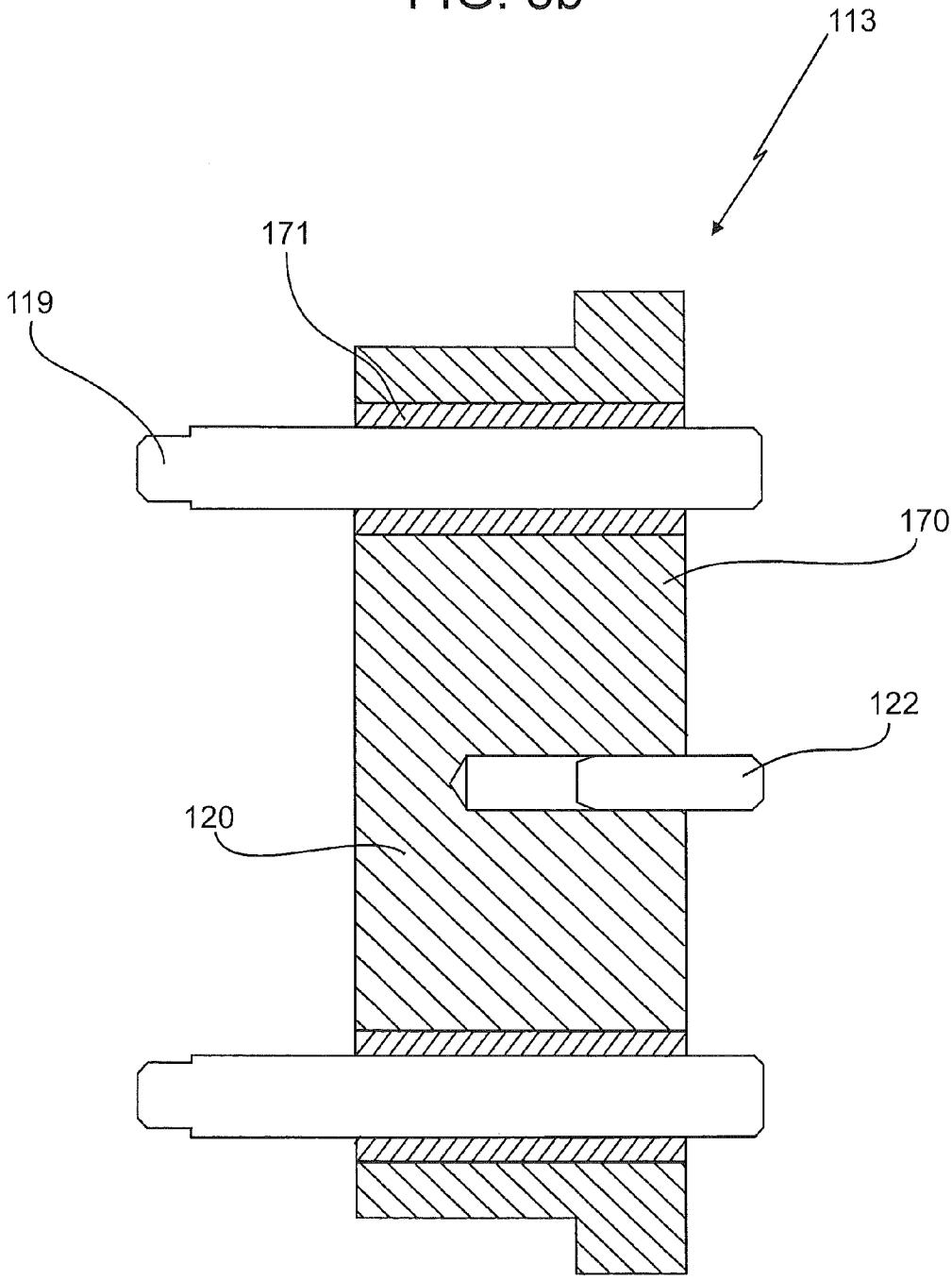

The seal of the insulating layer 124 to the conductive body 115 is preferably pressure tight against 30,000 psi (2000 bar). The conductive body 115 provides for an electrical connection between the carrier 110 and the segment 14. In this manner, the carrier 110 is tied to ground relative to the antennas 107. In one embodiment, the electrical connection between the conductive body 115 and the segment 14 may be realized by radial coil springs 104 mounted in grooves 123 of the conductive body 115 or other means contacting an inner diameter of a hole inside the segment 14. In one embodiment, a first end 150 of the conductive body 115 includes a collar 151 sized to fit inside and mate with a hole formed in the carrier 110. The size of the collar 151 is the determined based on the width of the carrier 110 in one embodiment and as illustrated in FIG. 7*a* where the collar 151 includes an end 152 that is substantially flush with an inner surface 153 of the carrier 110. Of course, such is not required. As illustrated in FIG. 8, the conductive body 115 also includes a second collar 154 that is optional.

Figure 9A:
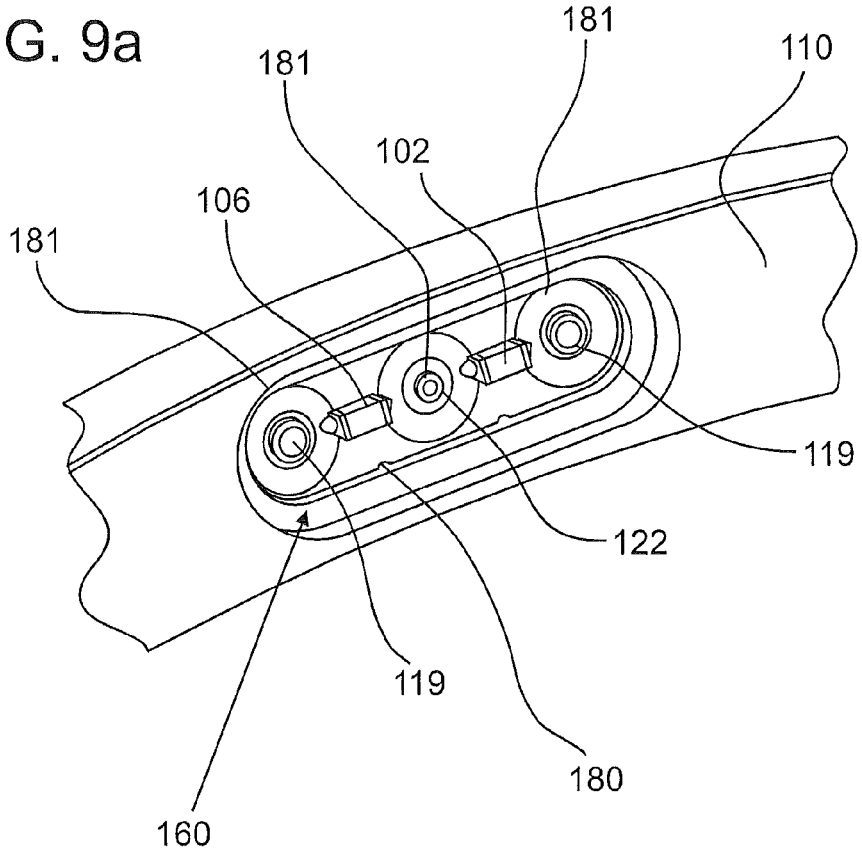
FIGS. 9*a* and 9*b* illustrate a carrier of a coupler in one embodiment before and after capacitors are sealed within the carrier.
Figure 9B:
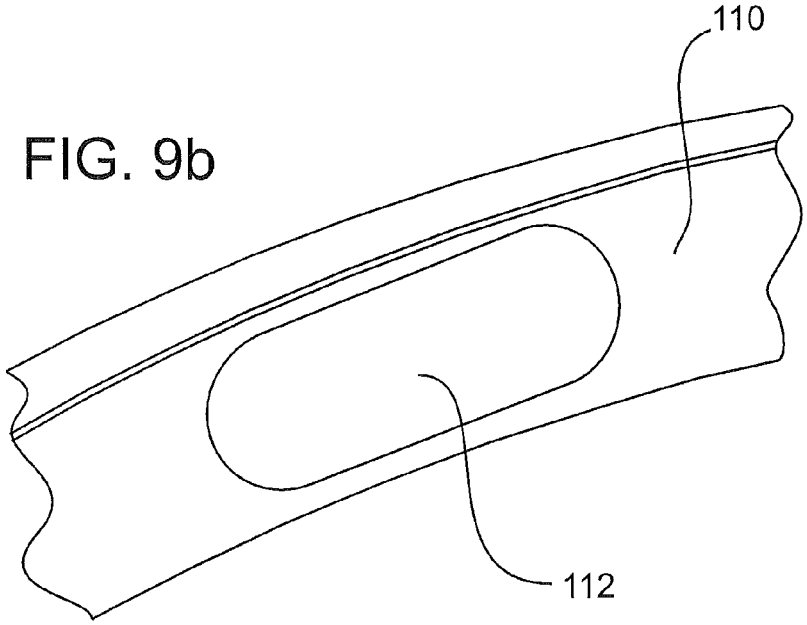

Referring again to FIGS. 6*a* and 6*b* and with further reference to FIGS. 8*a*, 8*b*, 9*a* and 9*b*, the coupler 100 also includes a double connector 113. As best seen in FIG. 8, the double connector 113 includes a body 120. The body is sized and configured to be placed into and welded or otherwise bonded to the carrier 110. Of course, pin body 120 and carrier 110 could be made by one piece forming an integral part. In one embodiment, a hole 160 that includes an inner lip 161 is formed in the carrier 110. The body of the double connector 113 is disposed in the hole such that it seats on the inner lip 161. When the double connector 113 is so situated the pins 119 are left exposed on the backside (FIG. 6*b*) of the carrier 110. The pins 119 are surrounded by insulating material that can be the same or similar to that described above with respect to insulating material 124 of the coupler connector 103. The connecting pin 122 can be formed at any location on a connection face 170 of the double carrier and is in electrical contact with the body 120 of the double connector 113. In another embodiment, the connecting pin 122 is eliminated by using a thin layer of metal on surface of the connection face 170 as electrical contact for the electronics (not shown). The coating material could be nickel, gold or other conductive metallization. FIG. 9*b* depicts an alternative 120 design of the pin body 120. The pin body forms a cavity that could be encapsulated by welding a cover 112 on the top of the cavity. As such, the electronics are protected when storing, transporting or handling the double connector during the manufacturing process of the coupler. As best understood with reference to FIG. 8*b*, the pins 119 are electrically isolated from the connecting pin 122 by insulating material as well as from the carrier 110 as assembled in FIG. 6*a*.

According to one embodiment, the pins 119 and the pin body 120 are connected to one another via electronic components. In one embodiment, the electronic components include at least one capacitor. It will be understood that the pin body 120 is in electrical contact with the carrier 110 which is in turn in electrical communication with the segment 14 either directly or through the conductive body 115 of the coupler connector 103 or both. In short, the pin body 120 represents a system ground and the pins 119 are connected to this ground via the electronic components. As will be understood, the pins 119 are in electrical contact with the antennas 107*a*, 107*b* of FIG. 5. In this manner, the antennas 107*a*, 107*b* are coupled to the system ground through the electronic components.

Figure 10:
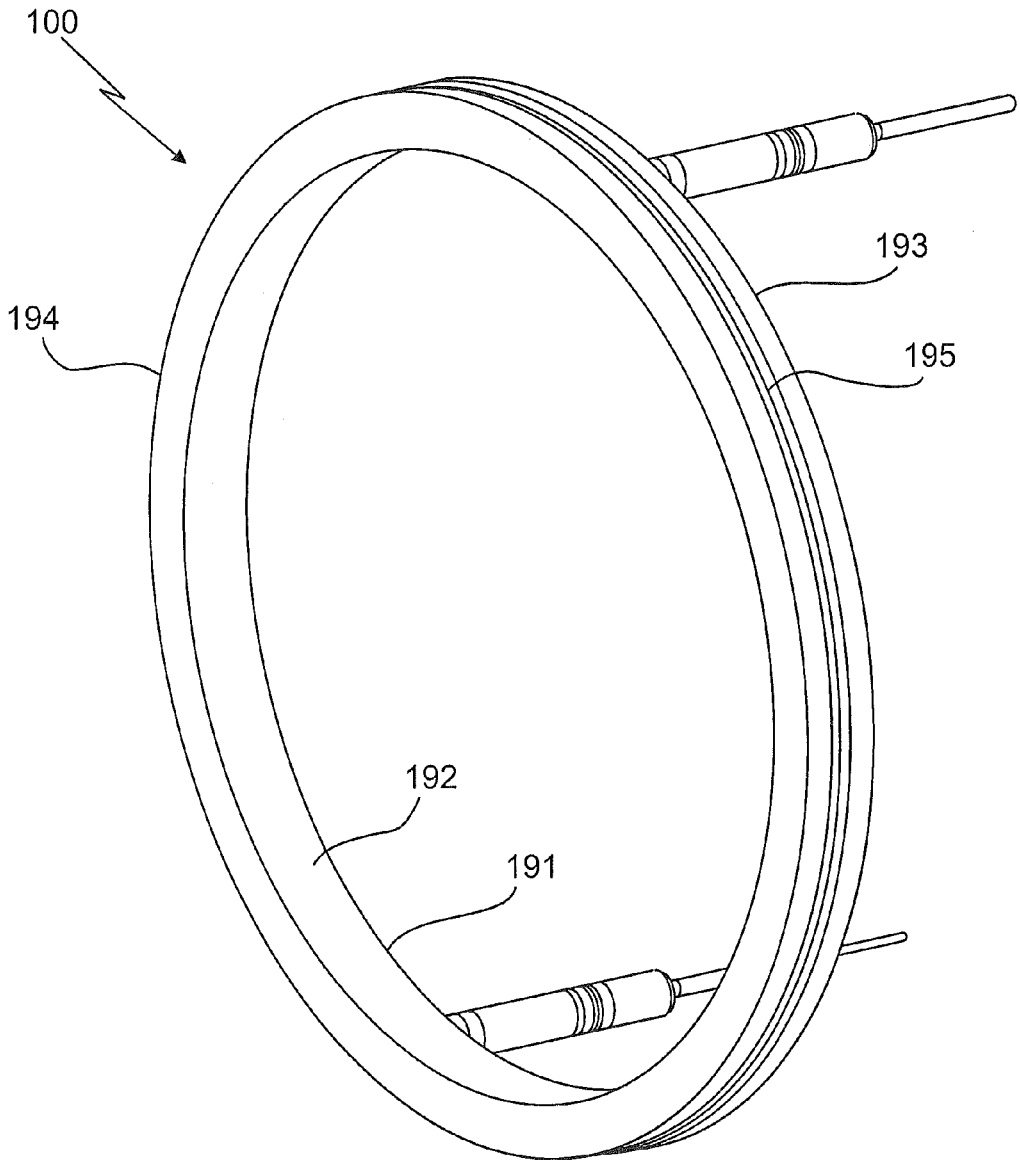
FIG. 10 shows a perspective view of coupler that includes metal disposed on some of its outer surfaces.

As discussed above, the electrical components carried by the pin body 120 can be capacitors. FIGS. 10*a* and 10*b* show one manner in which capacitors may be disposed within the carrier 110. Of course, the embodiment is presented by way of example only and other manners of disposing capacitors or any other type of electronic components within the carrier 110 and that connect pins 119 to connecting pin 122 will be apparent to the skilled artisan given the teachings herein. In the disclosed embodiment, the capacitors 102 and 106 connect respective ones of the pins 119 to the connecting pin 122. The capacitors 102 and 106 can be formed on a substrate 180 such as a printed circuit board. The substrate 180 can be sized such that it fits within the hole 160 and configured such that it includes contacts 181 that form electrical connections with pins 119 and the connecting pin 122. According to one embodiment, the hole 160 is sealed by a cover 112. In one embodiment, the cover 112 seals the hole 160 before the mold material 101 discussed above is formed on the coupler 100. In this manner the capacitors are protected from during the molding process. It shall be understood that the capacitors could also be embedded within the double pin connector itself Referring again to FIGS. 4 and 5, as is apparent from the above description, the antennas 107*a*, 107*b* receive signals from and provide signals to the pins 114 of the coupler connector 103. These signals can be power or data signals and may be measured relative the potential of the segment 14.

It has been discovered that the antennas 107 can generate eddy currents in the segment 14. These eddy currents produce electrical losses. To this end, and as best seen in FIG. 11, in one embodiment, to avoid losses in signal strength caused by stray capacitances into the magnetic steel of the segment 14, the backside 191 and the inner 192 and outer diameter 193 of the mold material 101 of the coupler 100 is coated with a metal such as copper. The front 194 is not coated in one embodiment. So, the coating of the coupler 110 with copper (except the front face) minimizes the electrical losses into the segment 14 (typically formed of steel with very poor conductivity). Copper has a very good conductivity and the eddy currents in copper produce lower losses than in steel. In other words, the copper coating has a shielding function. Of course, copper is not the only material that could be used for the coating. For instance, gold has also good conductivity may be used in one embodiment. Alternative methods to provide the shielding function could be the coating of the coupler groove 122 inside the segment 14 or an U-shaped metal ring, coating or foil covering the backside of the coupler.

Optionally, the outer diameter 193 may also include a groove 195 that is used to create a snap fit with a corresponding extension formed in the groove 122 of the segment 14 (FIG. 4).

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wired pipe segment comprising:

a body extending from a box end to a pin end;

a coupler located in one of the box and pin ends, the coupler including:

a carrier having at least one electrical component disposed therein; and one or more semi-circular antennas supported by and spaced from the carrier and being electrically coupled to the carrier through at least one of the electrical components, wherein each of the one or more semi-circular antennas extends less than 180 degrees; and a transmission line extending away from the coupler towards the other of the box and pin end and in electrical communication with the one or more antennas.

2. The wired pipe segment of claim 1, wherein the coupler further includes:

one or more spacers disposed between the carrier and the one or more antennas that hold the one or more antennas a fixed distance from the carrier.

3. The wired pipe segment of claim 2, wherein the one or more spacers are formed at least partially of a ceramic.

4. The wired pipe segment of claim 1, wherein the coupler further includes two coupler connectors.

5. The wired pipe segment of claim 4, wherein each of the one or more antennas is directly electrically connected a different one of the two coupler connectors.

6. The wired pipe segment of claim 4, wherein the transmission line includes two separate conduits, each of which is connected to a different one of the two coupler connectors.

7. The wired pipe segment of claim 1, wherein the coupler further includes:

a mold material that surrounds the carrier and the one or more antennas.

8. The wired pipe segment of claim 7, wherein the mold material is formed of polyether ether ketone (PEEK).

9. A wired pipe segment comprising:

a body extending from a box end to a pin end;

a coupler located in one of the box and pin ends, the coupler including:

a carrier having at least one electrical component disposed therein; and one or more antennas supported by and spaced from the carrier and being electrically coupled to the carrier through at least one of the electrical components;

a transmission line extending away from the coupler towards the other of the box and pin end and in electrical communication with the one or more antennas, a double connector that includes:

a body;

first and second pins that pass through the body and are physically and electrically isolated from the body by insulating material; and a connector pin extending from the body and electrically coupled to the body;

wherein a first one of the plurality of electrical components is electrically connected between the first pin and the connector pin and a second one of the plurality of electrical components is coupled between the second pin and the connector pin.

10. The wired pipe segment of claim 9, wherein the first and second ones of the plurality of electrical components are formed on a printed circuit board.

11. The wired pipe segment of claim 10, wherein the printed circuit board is disposed in a hole formed in the carrier.

12. The wired pipe segment of claim 11, wherein the carrier includes a cover that covers the hole and encloses the printed circuit board within the carrier.

13. The wired pipe segment of claim 11, wherein the double connector is also at least partially disposed in the hole and in contact with the printed circuit board.

14. A wired pipe coupler that carries at least a data signal comprising:

a carrier having a plurality of electrical components disposed therein; and one or more semi-circular antennas supported by and spaced from the carrier, the one or more antennas being electrically coupled to the carrier through respective ones of the plurality of electrical components, wherein each of the one or more semi-circular antennas extends less than 180 degrees.

15. The wired pipe coupler of claim 14, further comprising:

one or more spacers disposed between the carrier and the one or more antennas that hold the antennas a fixed distance from the carrier.

16. The wired pipe coupler of claim 15, wherein the one more spacers are formed at least partially of a ceramic or PEEK.

17. The wired pipe coupler of claim 14, wherein the coupler further includes two coupler connectors.

18. The wired pipe coupler of claim 17, wherein each of the one or more antennas is directly electrically coupled a different one of the two coupler connectors.

19. The wired pipe coupler of claim 14, wherein the coupler further includes:

a mold material that surrounds the carrier and the one or more antennas.

20. The wired pipe coupler of claim 19, wherein the mold material is formed of polyether ether ketone (PEEK).

21. The wired pipe coupler of claim 14, wherein the electrical components are capacitors.

22. A wired pipe coupler that carries at least a data signal comprising:

a carrier having a plurality of electrical components disposed therein;

one or more antennas supported by and spaced from the carrier, the one or more antennas being electrically coupled to the carrier through respective ones of the plurality of electrical components;

a double connector that includes:

a body;

first and second pins that pass through the body and are physically and electrically isolated from the body by insulating material; and a connector pin extending from the body and electrically coupled to the body;

wherein a first one of the plurality of electrical components is electrically connected between the first pin and the connector pin and a second one of the plurality of electrical components is coupled between the second pin and the connector pin.

23. The wired pipe coupler of claim 22, wherein the first and second ones of the plurality of electrical components are formed on a printed circuit board.

24. The wired pipe coupler of claim 23, wherein the printed circuit board is disposed in a hole formed in the carrier.

25. The wired pipe coupler of claim 24, wherein the carrier includes a cover that covers the hole and encloses the printed circuit board within the carrier.

26. The wired pipe coupler of claim 24, wherein the double connector is also at least partially disposed in the hole an end contact with the printed circuit board.

* * * * *